US008757445B2

(12) United States Patent
Robinson

(10) Patent No.: US 8,757,445 B2
(45) Date of Patent: Jun. 24, 2014

(54) COLD BLOCK WITH EMBEDDED CHAMBERED BEVERAGE TAP

(76) Inventor: Jon Joseph Robinson, Lakewood, CO (US)

( * ) Notice: Subject to any disclaimer, the term of this patent is extended or adjusted under 35 U.S.C. 154(b) by 5 days.

(21) Appl. No.: 13/369,219

(22) Filed: Feb. 8, 2012

(65) Prior Publication Data

US 2013/0200105 A1 Aug. 8, 2013

(51) Int. Cl.
*B67D 7/80* (2010.01)

(52) U.S. Cl.
USPC ..... 222/146.6

(58) Field of Classification Search
USPC ..... 222/129, 144, 146.1, 146.6; 62/394, 62/396
See application file for complete search history.

(56) References Cited

U.S. PATENT DOCUMENTS

| | | | | | |
|---|---|---|---|---|---|
| 2,259,852 | A | | 10/1941 | Hall | |
| 2,286,205 | A | | 6/1942 | Grubb | |
| 2,450,315 | A | | 9/1948 | Vetrano | |
| 2,612,357 | A | * | 9/1952 | Parks | 62/390 |
| 2,771,752 | A | * | 11/1956 | Tennant | 62/224 |
| 2,814,184 | A | * | 11/1957 | Johnson | 62/223 |
| 3,469,415 | A | * | 9/1969 | Cornelius | 62/394 |
| 3,556,347 | A | * | 1/1971 | Segal et al. | 222/132 |
| 4,094,445 | A | | 6/1978 | Bevan | |
| 4,730,463 | A | * | 3/1988 | Stanfill | 62/399 |
| 5,537,825 | A | | 7/1996 | Ward | |
| 5,564,602 | A | * | 10/1996 | Cleland et al. | 222/146.6 |
| 5,624,056 | A | * | 4/1997 | Martindale | 222/148 |
| 5,694,787 | A | | 12/1997 | Cleland et al. | |
| 5,873,259 | A | * | 2/1999 | Spillman | 62/396 |
| 6,237,652 | B1 | | 5/2001 | Nelson | |
| 6,360,556 | B1 | | 3/2002 | Gagliano | |
| 7,140,514 | B2 | | 11/2006 | Van Der Klaauw et al. | |
| 7,188,751 | B2 | | 3/2007 | Van Der Klaauw et al. | |
| 7,272,951 | B2 | | 9/2007 | Kyees | |
| 8,079,230 | B2 | * | 12/2011 | Frank et al. | 62/303 |

* cited by examiner

*Primary Examiner* — Paul R Durand
*Assistant Examiner* — Donnell Long
(74) *Attorney, Agent, or Firm* — Barber Legal; Craig W. Barber

(57) ABSTRACT

A beverage tower having a cold block with glycol recirculation, the tap/valve is built into the cold block, so as to keep the entire beverage tap cold and maintain the beverages in a sanitary condition meeting health codes. The glycol lines within the cold block pass around the tap in the cold block in serpentine fashion or in a coolant chamber, resulting in a tap which remains cooled effectively, while the cold block provides thermal inertia to the system. Serpentine channels may further be used so that the beverage passing through the beverage supply channels has a longer run in contact with the conductive material of the cold block and more opportunity to reject heat. Various types of towers may benefit from the present invention: traditional, hand-operated, automated, multiple-tap, towers also otherwise cooled, decorative towers and so on.

18 Claims, 7 Drawing Sheets

COLD BLOCK WITH EMBEDDED CHAMBERED BEVERAGE TAP

STATEMENT REGARDING FEDERALLY FUNDED RESEARCH

This invention was not made under contract with an agency of the US Government, nor by any agency of the US Government.

CROSS-REFERENCE TO RELATED APPLICATIONS

This invention claims the priority and benefit of co-pending U.S. patent application Ser. No. 12/321,341 filed Jan. 17, 2009 in the name of the same inventor, Jon Joseph Robinson, and entitled "COLD BLOCK WITH INTEGRAL BEER TAP" for which the entire applications including disclosures are incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

FIELD OF THE INVENTION

This invention relates generally to beverage taps.

BACKGROUND OF THE INVENTION

In beverage dispensing technology, it is imperative for both sanitary and regulatory reasons to maintain consistent, stable and low temperatures in many products while they are being dispensed. Cooling has been shown to slow bacterial growth, which is important for beverages which must be kept cold at all times so as to maintain sanitary conditions and assist maintenance of sanitary conditions for the beverage, in keeping with food safety codes. The importance of this can be understood in the following terms: if a product cannot be maintained at the proper temperature in conformity with regulations on health and safety, then the product simply cannot be dispensed. Thus the entire shape of industries such as drinking, food management and entertainment can be altered by the practical limits of temperature control. Different products have different regulatory standards, for example, NSF 18 is applicable to general beverage technology, while NSF 20 is applicable to bulk milk dispensing.

A typical beverage dispensing tower is shown in FIGS. 10A, 10B and 10C, a tap type which might be manufactured by Perlick or any other manufacturer for many years. The tower 102 has a top 104 and a tap 106 (106, 106A, 106B). Tap 106 projects out from the front of the tower top 104, on shank 116. A shank assembly 116 is embedded inside of a cold block 120. Tap handle 114 includes an internal faucet lever that is attached to an internal valve stem having at least two positions (forward/open and backward/closed), and thus allows beverages to be dispensed from orifice 112, due to the presence of the internal valve. Note that the valve usually (in most designs) cuts off flow at 108, which is the rear of the faucet, and the location of the valve seat, and so some of the beverage which is held within the system is inside the tap 106 and will essentially drain out after the tap is closed. This is important as there is a "cold block" 120 within the tower (102/104). The cold block keeps the beverage within the tower cold as the beverage stops at the valve seat at the intersection of 110 and 120. (The tap 106, however, essentially only receives a minimum of cooling by conduction from cold block 120 through the shank assembly 116.)

Thus standard designs do not hold beverage within the faucet body 106: there is beverage at 108 and the point of dispense is functionally at 108. To reiterate, the significant factor here is the ability to meet regulatory standards: business and other considerations must conform to this overriding issue.

In other designs such as the Perlick "sanitary faucet" 106A or stout faucets such as 106B, the valve is reversed and beverage remains within the faucet, attempting to rely upon the conduction from the cold block to keep the external faucet cold.

The prior art "cold block" as used for many decades is a conductive block with channels running through it. The channels carry glycol coolant, which is kept separated from one or more product channels carrying the beverage. The channels of glycol can absorb large amounts of heat and carry it away to a heat exchanger such as a radiator located at a remote location. The aluminum or Kirksite composite (a zinc alloy typically having a modest amount of aluminum and copper) cold block has excellent heat transmission properties, heat rejected by the beverage as it passes through the cold block can easily enter the cold block and then be rejected into the glycol and away. If the valve location 108 is situated projecting near the cold block 120 (as some products by Perlick and others have had for 50 years or more) then the traditional arrangement keeps the beverage cold right to the point of dispense at valve part 108. The glycol channels in the prior art arrangements may run throughout cold block 120 in any of a wide range of ways, for example, the glycol channels may run right to the point of dispense at valve part 110 (except of course Perlick sanitary faucets, stout faucets and the like).

Other systems teach using glycol lines to cool the feed lines running up to the valves but with no true cold block (as in soft drink fountain systems).

Various types of systems have been proposed.

U.S. Pat. Nos. 7,188,751 and 7,140,514 issued Mar. 13, 2008 and Nov. 28, 2006 to Van Der Klaauw et al, U.S. Pat. No. 6,360,556 issued Mar. 26, 2002 to Gagliano, U.S. Pat. No. 6,237,652 issued May 29, 2001 to Nelson, U.S. Pat. No. 5,873,259 issued Feb. 23, 1999 to Spillman, U.S. Pat. No. 5,694,787 issued Dec. 9, 1997 to Cleland et al, U.S. Pat. No. 5,537,825 issued Jul. 23, 1996 to Ward, U.S. Pat. No. 4,094,445 issued Jun. 13, 1978 to Bevan, U.S. Pat. No. 2,450,315 issued Sep. 29, 1948 to Vetrano, U.S. Pat. No. 2,286,205 issued Jun. 16, 1942 issued to Grubb, U.S. Pat. No. 2,259,852 issued Oct. 21, 1941 to Hall show some typical examples of the prior art in the field.

U.S. Pat. No. 7,272,951 issued Sep. 25, 2007 to Kyees teaches that the cooling lines in a cold block may pass about the tap shank and/or socket fittings (not the tap heads themselves). The tap heads still project from the tower, as may be seen in FIG. 14*b* of the reference.

However, it is not generally known to actually place the traditional stout tap into the cold block itself, then run coolant lines all the way around the tap while staying entirely within the cold block. It is further not generally known to actually place a wide range of beverage taps into a cold block having coolant lines running all the way around tap within a temperature control block. It is further not generally known to actually place a portion control mechanism within a temperature control block.

Significantly, it is NOT known to provide a coolant chamber around the tap mechanism and within a temperature control block, thus providing highly stable temperatures right to very verge of dispensing of beverages such as milk, coffee, beer, or the like.

It would be desirable to provide a device which allows beverages to be maintained at a desirable determined temperature including when the beverage is within the actual tap itself, by placing the taps within the cold block.

SUMMARY OF THE INVENTION

General Summary

The present invention teaches a beverage tower of the type having a cold block, or more broadly a temperature control block, with glycol recirculation, and further in which the stout-style of tap does not project from the block but rather is actually built into the cold block, so as to keep the entire beverage tap body cold. This tap embedded cold block presents a number of advantages over known prior art, most especially, the ability to maintain dairy products at a consistently safe temperature which meets regulatory approval.

By contrast, traditional systems, which tend to be useful strictly for beer technology, have one end of the tap or the valve seat of the tap located just beyond (exterior to) a cold block. By contrast, the present invention teaches that the entire stout tap or other similar tap (with the exception of parts such as a handle or a self-draining nozzle orifice) may be located within the cold block and is thus useful for many diverse beverages. Beverages like milk passing through the cold block thus are maintained consistently cold while waiting in the block.

To further increase the effectiveness of the design, not only are there coolant channels which wind in serpentine fashion about the beverage channels and the tap itself, but there may also be provided a coolant chamber. The coolant chamber may have the tap sealed within the coolant chamber and the coolant chamber may then itself be embedded within the cold block. It is axiomatic that the coolant lines and coolant chamber are hydraulically separated in all ways and at all points from the beverage channels.

The glycol lines within the cold block may optionally be arranged so as to pass around the tap in the cold block, even around the entire tap, with a 360 degree envelopment on all sides. This results in the tap remaining cooled so long as the glycol recirculation system keeps the block in which it is embedded cold. However, with the addition of a coolant chamber not only is 360 degree envelopment provided but in addition, a larger heat rejection capability is provided as well: the coolant mass in proximity to the tap valve is greater and thus provides faster cooling. This design does not sacrifice the temperature stability provided by the cold block, either, as the coolant itself is maintained in a cold condition by the thermal mass of the cold block.

Serpentine beverage supply channels (and of course glycol channels as well) may be employed so that the beverage passing through the beverage supply channels has a longer run and longer time in contact with the cooled conductive material of the cold block, though the invention is about the location of the tap and the ability to better maintain already cool beverages. This provides more time and contact opportunity to reject heat from the beverage to the block and assist in maintaining sanitary conditions for the beverage.

Heat rejected from the beverage into the coolant chamber is then rejected into the coolant within the chamber (or further rejected into the cold block) is then of course moved in the moving coolant or rejected again into the glycol in the glycol channels (which are entirely sealed from the beverage channels) and carried away by a glycol recirculation pump back to the glycol storage bath within the glycol refrigeration unit.

Tested versions (so far the versions with coolant lines passing about the tap) with straight beverage supply lines passing through the block to a tap entirely within the cold block have passed NSF 18. and NSF 20.

In addition, automated portion control may be achieved by embedding within not only the tap/valve but also the operating end (plunger end) of a solenoid, such as an electrical solenoid, or more realistically a gas operated solenoid, but any type may be employed.

Further in addition, the design may be used in multiple-tap beverage towers.

Finally, the present design may be used with a heating fluid instead of a coolant, resulting in the "cold block" becoming a "hot block" and providing thermal momentum to maintain a steady and constant high temperature. It will be understood that the terms "cold" and "cold block" used herein may refer to heat and the cold block may function as a hot block. If the broader term "temperature control block" is used, however, it will be understood that the block, while novel due to its aspects and elements, includes the term "cold block" and for the detailed description and claims of the invention, the two terms may be used interchangeably.

Thus the entire range of beverage towers can be used with the present invention, traditional, hand-operated, automated, multiple-tap, towers otherwise cooled, decorative towers and so on.

Summary in Reference to Claims

It is therefore another aspect, advantage, objective and embodiment of the invention, in addition to those discussed previously, to provide a beverage dispensing device comprising:

- a cold block having a body made of a heat conducting material;
- at least one tap, the tap and its beverage/valve portions embedded within the cold block;
- at least one beverage channel passing through the cold block to the at least one tap;
- at least one coolant channel passing through the cold lock to the at least one tap and passing about the tap within the cold block.

It is therefore another aspect, advantage, objective and embodiment of the invention, in addition to those discussed previously a beverage dispensing device wherein at least one of the beverage channel, and the coolant channel, is serpentine within the cold block.

It is therefore another aspect, advantage, objective and embodiment of the invention, in addition to those discussed previously a beverage dispensing device further comprising:

- a beverage tower, the cold block disposed within the beverage tower.

It is therefore another aspect, advantage, objective and embodiment of the invention, in addition to those discussed previously a beverage dispensing device further comprising:

- a second tap and its beverage/valve portions embedded within the cold block;
- a second beverage channel passing through the cold block to the second tap;

the at least one coolant channel passing through the cold block to the at second tap and passing about the second tap within the cold block.

It is therefore another aspect, advantage, objective and embodiment of the invention, in addition to those discussed previously a beverage dispensing device further comprising:

a glycol return allowing glycol in the cold block coolant channel to re-circulate to a glycol cooling and re-circulation unit.

It is therefore another aspect, advantage, objective and embodiment of the invention, in addition to those discussed previously a beverage dispensing device further comprising:

first and second beverage supplies.

It is therefore another aspect, advantage, objective and embodiment of the invention, in addition to those discussed previously a beverage dispensing device wherein the first and second beverage supplies further comprise containers having therein one member selected from the group consisting of: milk, non-dairy products, carbonated and non-carbonated beer, other alcoholic beverages, syrups, water, coffee and tea, fruit juice and combinations thereof.

It is therefore another aspect, advantage, objective and embodiment of the invention, in addition to those discussed previously a beverage dispensing device comprising:

a cold block having a body made of a heat conducting material;

at least one solenoid, the solenoid being at least partially embedded within the cold block;

at least one tap having a tap valve having a portion for containing beverage, the tap valve and its beverage containing portions embedded within the cold block, the tap being mechanically engaged to the solenoid whereby the solenoid controls the operation of the tap, the portion of the solenoid mechanically engaged to the tap valve being embedded within the cold block;

at least one beverage channel passing through the cold block to the at least one tap valve beverage containing portions; and at least one coolant channel passing through the cold lock to the at least one tap and passing about the tap within the cold block.

It is therefore another aspect, advantage, objective and embodiment of the invention, in addition to those discussed previously a beverage dispensing device wherein at least one of the beverage channel, and the coolant channel, is serpentine within the cold block.

It is therefore another aspect, advantage, objective and embodiment of the invention, in addition to those discussed previously a beverage dispensing device further comprising:

a beverage tower, the cold block disposed within the beverage tower, a second tap and its beverage/valve portions embedded within the cold block;

a second beverage channel passing through the cold block to the second tap;

the at least one coolant channel passing through the cold block to the at second tap and passing about the second tap within the cold block.

It is therefore another aspect, advantage, objective and embodiment of the invention, in addition to those discussed previously a beverage dispensing device further comprising:

a glycol return allowing glycol in the cold block coolant channel to re-circulate to a glycol cooling and re-circulation unit.

It is therefore another aspect, advantage, objective and embodiment of the invention, in addition to those discussed previously a beverage dispensing device further comprising:

first and second beverage supplies, wherein the first and second beverage supplies further comprise containers having therein one member selected from the group consisting of: milk, non-dairy products, carbonated and non-carbonated beer, other alcoholic beverages, syrups, water, coffee and tea, fruit juice and combinations thereof.

It is therefore another aspect, advantage, objective and embodiment of the invention, in addition to those discussed previously a beverage dispensing device comprising:

a cold block having a body made of a heat conducting material;

at least one tap, the tap and its beverage/valve portions embedded within a coolant chamber, the coolant chamber in turn embedded with the cold block;

at least one beverage channel passing through the cold block to the at least one tap;

at least one coolant channel passing through the cold block to the coolant chamber.

It is therefore another aspect, advantage, objective and embodiment of the invention, in addition to those discussed previously a beverage dispensing device further comprising:

at least one solenoid, the solenoid being at least partially embedded within the coolant chamber;

the tap having a tap valve, the tap valve being mechanically engaged to the solenoid whereby the solenoid controls the operation of the tap, the portion of the solenoid mechanically engaged to the tap valve being embedded within the coolant chamber.

It is therefore another aspect, advantage, objective and embodiment of the invention, in addition to those discussed previously a beverage dispensing device wherein at least one of the beverage channel, and the coolant channel, is serpentine within the cold block.

It is therefore another aspect, advantage, objective and embodiment of the invention, in addition to those discussed previously a beverage dispensing device further comprising:

a beverage tower, the cold block disposed within the beverage tower, a second tap and its beverage/valve portions embedded within a second coolant chamber also in turn embedded within the cold block;

a second beverage channel passing through the cold block to the second tap;

the at least one coolant channel passing through the cold block to the second coolant chamber.

It is therefore another aspect, advantage, objective and embodiment of the invention, in addition to those discussed previously a beverage dispensing device further comprising:

a glycol return allowing glycol in the cold block coolant channel to re-circulate to a glycol cooling and re-circulation unit.

It is therefore another aspect, advantage, objective and embodiment of the invention, in addition to those discussed previously a beverage dispensing device further comprising:

first and second beverage supplies, wherein the first and second beverage supplies further comprise containers having therein one member selected from the group consisting of: milk, non-dairy products, carbonated and non-carbonated beer, other alcoholic beverages, syrups, water, coffee and tea, fruit juice and combinations thereof.

INDEX TO REFERENCE NUMERALS

102 Tower
104 Tower top
106 General tap
106A Perlick Sanitary Tap
106B Stout Tap
108 Valve Point of Dispense
110 Tap/Shank Coupling Nut
112 Tap Orifice (outlet)
114 Tap Handle
116 Embedded Shank Assembly
120 Cold Block
122 Cold Block Insulating Foam
124 Embedded Shank Socket (optional)
126 Beverage Cooling Channel
1000 tap body
1002 coolant chamber (interior)
1004 tap body exterior (coolant chamber)
1005 coolant chamber body (exterior)
1006 coolant chamber inlet/outlet
1008 coolant chamber inlet/outlet
1010 tap cap (top)
1012 tap portion control solenoid
1014 tap solenoid valve plunger
1016 tap beverage inlet
1018 tap beverage outlet
1020 tap outlet nozzle
1022 tap valve O-rings
1024 solenoid gas outlet
1026 solenoid gas inlet
1030 cold block
1050 coolant feed line
1052 upper coolant channel
1054 lower coolant channel
1056 coolant return line
1058 coolant channel bridge
1060 beverage feed line
1062 beverage cooling channel
1070 chambered tap

DETAILED DESCRIPTION

Figure 1:
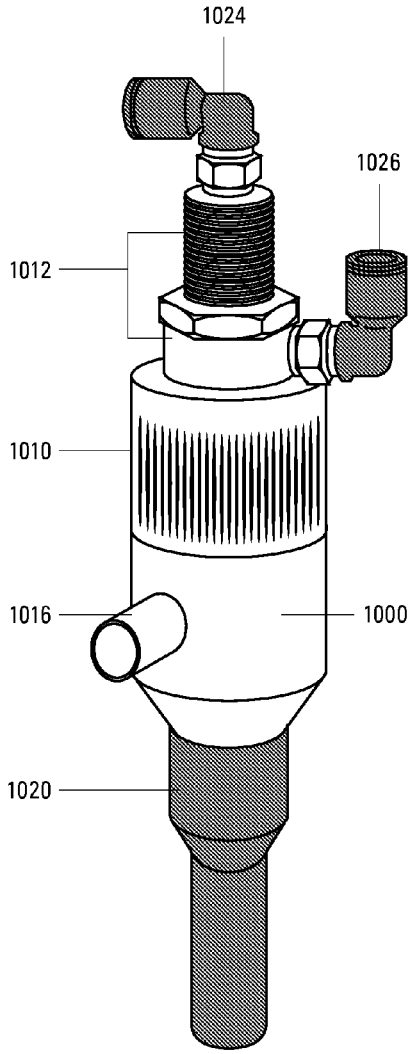
FIG. 1 is a perspective view of a gas solenoid controlled tap.
Figure 2:
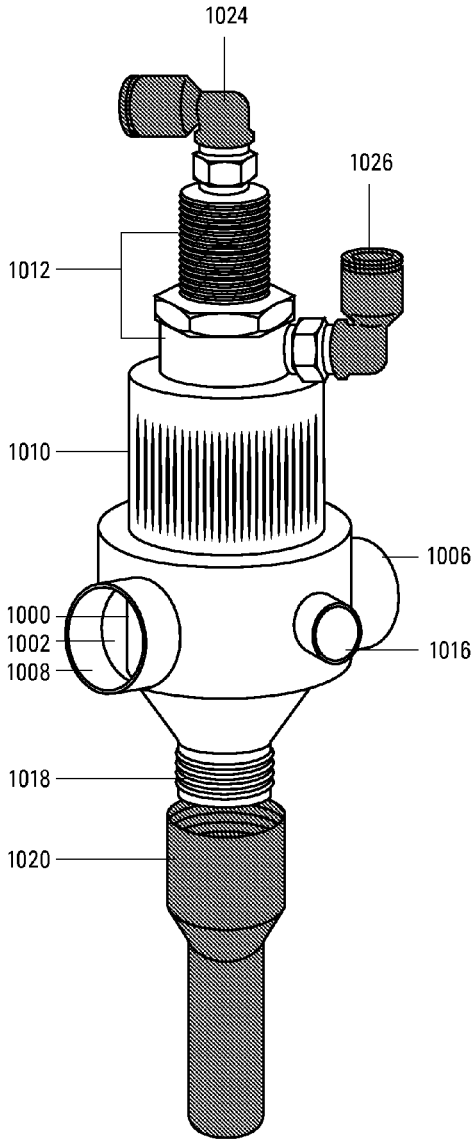
FIG. 2 is a perspective view of a second embodiment of the invention, a gas solenoid controlled tap within a coolant chamber.

FIG. 1 is a perspective view of a gas solenoid controlled tap having a tap, a solenoid, gas inlets and so on. (This simple alternative embodiment of the invention may be distinguished by the fact that it lacks the coolant chamber which is the preferred embodiment, and which is shown in FIG. 2 et seq.) In FIG. 1, tap body 1000 is shown without the cold block within which it is embedded, the cold block is shown in later figures. Tap body 1000 has a tap cap 1010, as well as tap portion control solenoid 1012. Beverage inlet 1016 is obviously provided to allow entry of beverages into the tap, within which they will pass the solenoid plunger, the outlet and finally exit from the tap body 1000 by way of tap outlet nozzle 1020. Tap portion control solenoid 1012 has a gas outlet 1024 and a gas inlet 1026. In operation, the gas flowing through these ports 1024/1026 (and through the lines connected thereto) controls operation of the tap solenoid 1012 and thus controls operation of the tap and the portion controlled dispensing of beverages.

While FIG. 1 depicts an entirely separable embodiment of the invention requiring no additional aspects, advantages and elements of the invention to work when embedded in a cold block with coolant lines thereabout, it may in fact advantageously considered to be the core of the preferred embodiment of the invention depicted in FIG. 2, and for this reason shares numbering therewith.

FIG. 2 is a perspective view of a second embodiment of the invention, a gas solenoid controlled tap within a coolant chamber. In the presently preferred embodiment and best mode presently contemplated for carrying out the invention, the gas solenoid portion controlled tap is within the coolant chamber of the invention. Tap body 1000 is slightly visible in the coolant chamber interior 1002 though the aperture of coolant chamber outlet 1008, the larger port thereon. Coolant chamber outlet 1006 is partially visible on the distal side of the device. In operation, either of coolant chamber outlets 1006/1008 may in fact function as a coolant inlet, the term outlet is used generically in this case. Tap beverage inlet 1016 is shown at a 90 degree angle from the first embodiment: it may be oriented in any convenient direction or may connect internally within the chamber 1002. Finally, tap outlet nozzle 1020 is shown disengaged from but proximal to and oriented with tap beverage outlet 1018, so as to show the relationship therebetween: the tap outlet nozzle 1020 may physically engage, either directly as shown or indirectly with intervening parts to tap beverage outlet 1018. In this preferred embodiment the engagement is threading, allowing easy disassembly and cleaning, but other methods may be employed in alternative embodiments. Note that such disassembly and cleaning, at least in part, may well be, depending upon exact regulations, a legal necessity for at least parts of the tap of the invention.

Operation of the device in general terms may be partially understood with reference to FIG. 2. Solenoid 1012 has an internal plunger which controls beverage flow. Under normally closed conditions, solenoid 1012 blocks flow. Beverage is provided and available but not flowing into the tap body 1000 through tap beverage inlet port 1016. Meanwhile coolant may be found to be entering and leaving the coolant chamber interior 1002 by way of the two coolant chamber outlets 1006/1008 (continuously in the preferred embodiments, although the invention is not limited to this). Finally, the gas which controls the operation of the solenoid 1012 is pressurized or available to solenoid gas inlet 1026.

When beverage is to be dispensed, solenoid gas inlet 1026 alters the flow of gas so as to actuate solenoid 1012, which causes the flow of beverage to be enabled. Note that coolant flow through the coolant chamber (the interior) 1002 and beverage flow through tap beverage inlet 1016, the tab body 1000, past the solenoid plunger and out tap beverage outlet 1018 and tap outlet nozzle 1020 in fact may be entirely unrelated, may be related by automated temperature controls, or may be directly linked, so that actuation of one causes the flow of new coolant. In the presently preferred embodiment, the flow of coolant is dependent only upon temperature maintenance considerations and not upon flow of the beverage. As noted previously, the coolant and the beverage are entirely separate.

Figure 3:
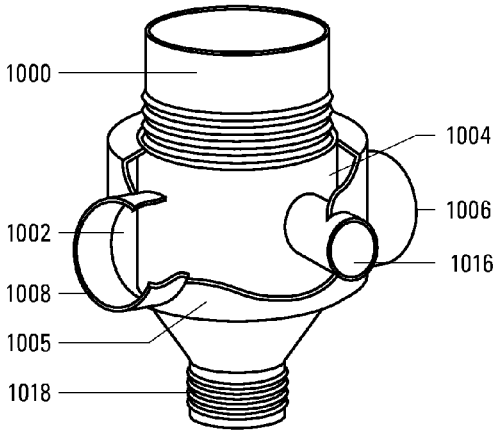
FIG. 3 is a partially cutaway perspective view of the coolant chamber of the second embodiment of the invention.

FIG. 3 is a partially cutaway perspective view of the coolant chamber of the second embodiment of the invention. The structural details of the coolant chamber may be better understood by reference to this diagram.

The tap body exterior 1004 of tap body 1000 of FIG. 3 is surrounded by the hollowed toroidal shape coolant chamber (interior) 1002 of this embodiment. Coolant is supplied and removed from coolant chamber outlets 1006/1008 and partially or wholly fills the coolant chamber interior 1002. In the preferred embodiments, the coolant chamber is largely or entirely filled.

The size and shape of the coolant chamber 1002 (interior) is obviously defined by the coolant chamber body (or exterior or wall) 1005, and this may be any shape chosen for cooling efficiency or the constraints of the beverage dispensing apparatus, such as size, shape and so on. It will be understood that the tap body 1000 is thus disposed within the coolant chamber 1002 while the coolant chamber body 1005 is in turn embedded within the cold block of aluminum or Kirksite or other suitable material. Note that any suitable material now known or later developed will fall within the scope of the appended claims. Beverage, as noted previously, enters through tap beverage inlet 1016 and exit through tap beverage outlet 1018.

Figure 4:
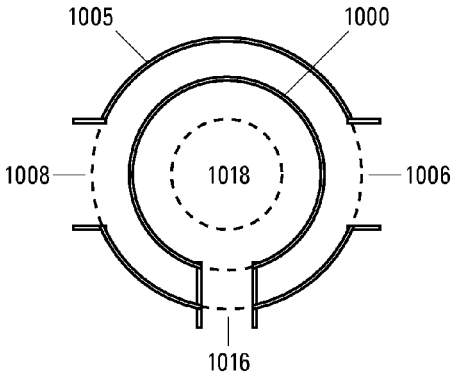
FIG. 4 is a partial and planform cross-sectional view of the second embodiment of the invention, showing the embedding of the solenoid controlled tap within the coolant chamber.

FIG. 4 is a partial and planform (top) cross-sectional view of the second embodiment of the invention, showing the embedding of the solenoid controlled tap within the coolant chamber. The tap solenoid valve plunger 1014 (FIG. 5) fits within the space defined by tap body 1000, while coolant flows within the toroidal (doughnut shaped) space (the coolant chamber 1002) defined by the tap body 1000 and the coolant chamber body exterior 1005. The penetration of tap beverage inlet 1016 through this space without allowing mixing with coolant may be seen as well. (Coolant of course might be a material harmful to human health, such as glycol. Other non-inimical coolants such as water or the like might still negatively impact taste of the dispensed beverage. Thus this aspect of the invention is very important).

Figure 5:
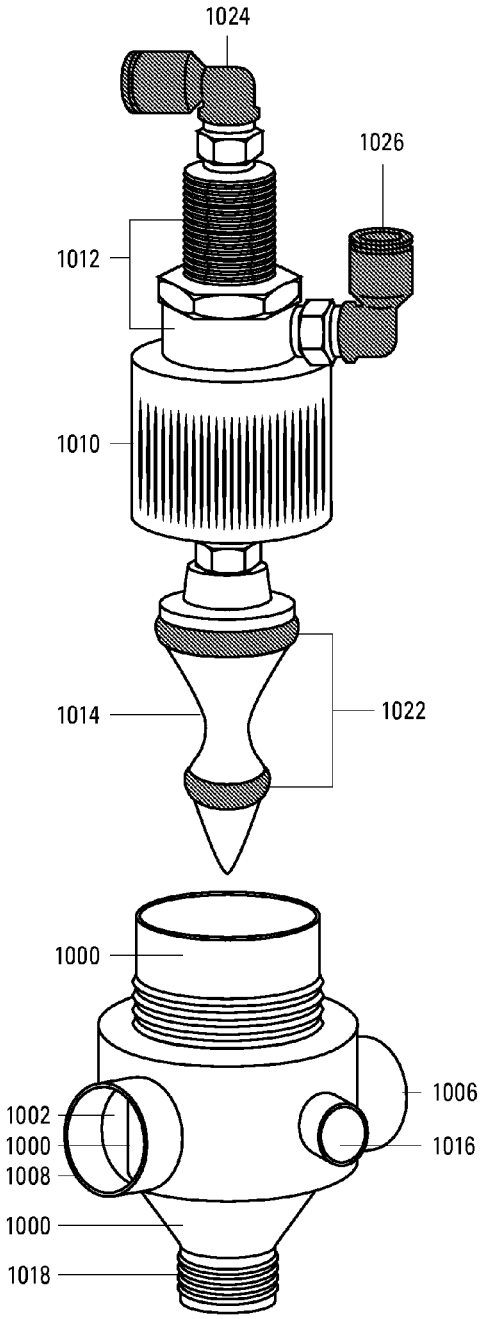
FIG. 5 is an exploded view of the second embodiment of the invention showing the gas solenoid controlled tap with the coolant chamber beneath it.

FIG. 5 is an exploded view of the second embodiment of the invention showing the gas solenoid controlled tap with the coolant chamber beneath it. This diagram provides a clear understanding of the use of tap solenoid valve plunger 1014. The tap solenoid valve plunger 1014 will normally have a plurality of positions within the tap body 1000. In a first position, the plunger, potentially by means of tap valve O-rings 1022 (as in this embodiment) or by similar seals, or by other means prevents flow of beverage. In the second position, the plunger moves, for example, in translation and upward, and thus allows flow. Obviously, the motion may be translation or rotation and may be in any direction and dimension within the scope of the invention, although the arrangement shown in FIG. 5 is regarded as most practical at the present time. Finally, it is potentially possible for the tap solenoid valve plunger 1014 to have yet a third or additional positions, for example, allowing different rates of flow, and yet be within the scope of the invention.

Figure 6:
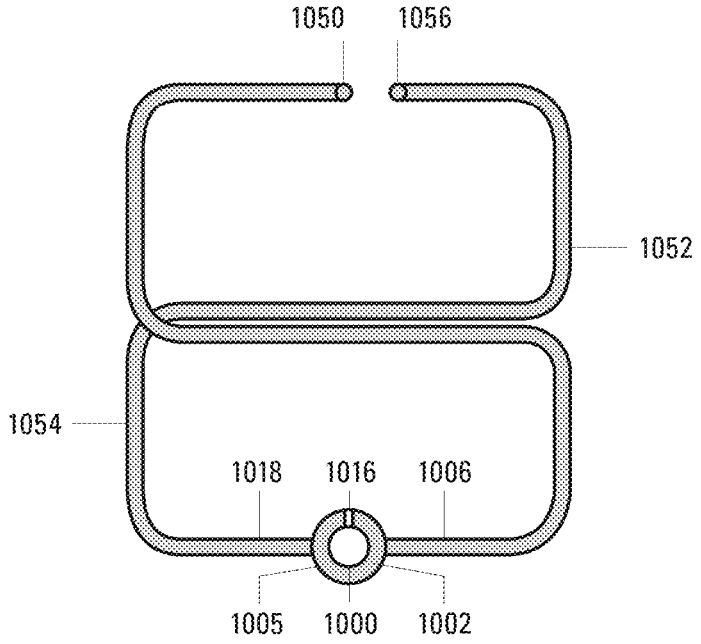
FIG. 6 is a planform or schematic view of the coolant channels of the invention showing the serpentine nature of the channels.

FIG. 6 is a planform or schematic view of the coolant channels of the invention showing the serpentine nature of the channels. Coolant feed line 1050 delivers coolant from a coolant system through lower coolant channel 1052 to coolant chamber outlet 1006, thus feeding cold coolant to the coolant chamber 1002. Coolant chamber outlet 1008 removes coolant from the chamber to lower coolant channel 1054 and thus coolant return line 1056. The tap beverage inlet 1016 may be seen to be separate from the coolant channels. The serpentine beverage channels may be seen in the next diagram.

Figure 7:
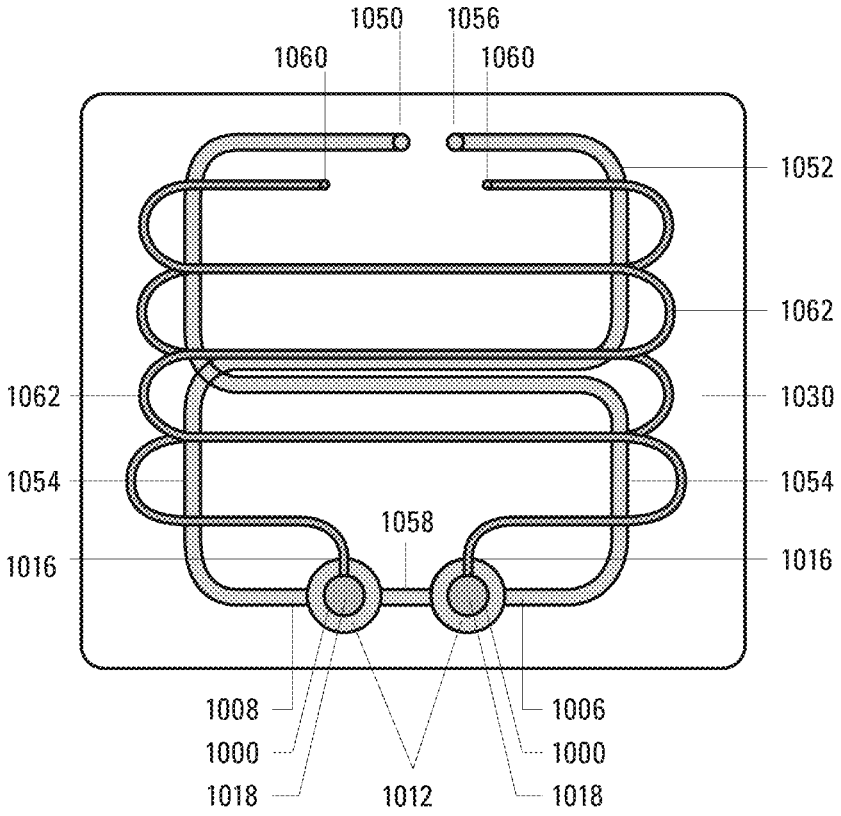
FIG. 7 is a planform cutaway view of the beverage channels and the coolant channels within a cold block embodiment of the invention.

FIG. 7 is a transparent planform or cutaway view of the beverage channels and the coolant channels within a cold block and two taps embodiment of the invention. In general, the overall configuration of the coolant channels is similar to that of the previously depicted single tap embodiment, however, in this embodiment there are two taps. Thus, coolant feed line 1050 again delivers coolant from a coolant system (not shown but present in the mother application, the entire disclosure of which has been incorporated by reference) through lower coolant channel 1052 to coolant chamber outlet 1006, thus feeding cold coolant to the dual coolant chambers. Coolant passes from one coolant chamber to another coolant chamber by means of coolant channel bridge 1058. Coolant chamber outlet 1008 removes coolant from the two chambers to lower coolant channel 1054 and thus coolant return line 1056. The tap beverage inlet 1016 may be seen to be separate from the coolant channels.

However, this figure also depicts the cold block 1030, in which the coolant lines and the beverage lines and the coolant chambers and the taps within the coolant chambers are all embedded. Beverage feed line 1060 provides a beverage to a tap, since there are two beverage feed lines, two different beverages may be supplied. The serpentine beverage feed line 1060 becomes beverage cooling channel 1062.

In operation, the beverage passes through the channels on the way to the tap, and in so doing rejects heat from the fluid of the beverage into the cold block 1030, which in turn rejects the heat into the coolant lines.

Figure 8:
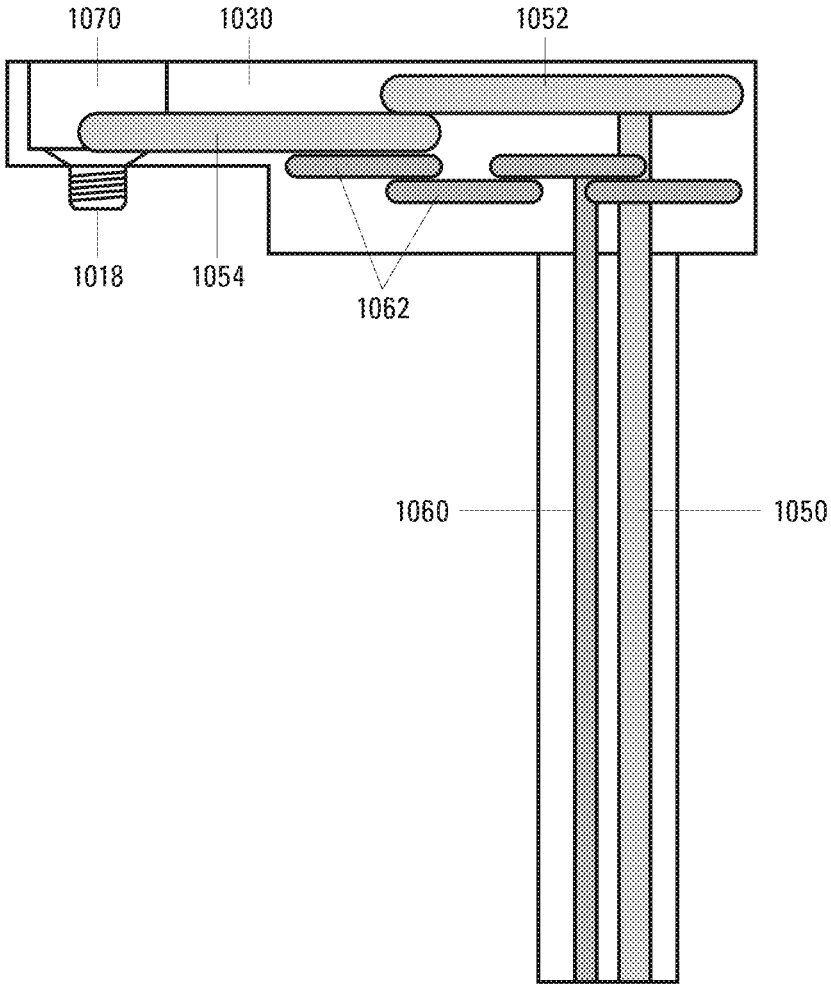
FIG. 8 is a cutaway side view of the beverage and coolant supplies, the coolant channels and the beverage channels of a cold block of the chambered embodiment of the invention.

FIG. 8 is a transparent or cutaway side view of the cold block, beverage and coolant supplies, the coolant channels and the beverage channels of a cold block of the invention. The cold block has a projecting top; the tap 1070 and chamber embedded within the cold block. Beverage lines 1062 may be seen within the cold block, below the coolant lines 1052. Tap beverage outlet 1018 may be seen to project slightly from the bottom of the block. The actuator (not shown), for example the solenoid for automatic portion control or a manual tap handle or other, may project from the top of the chamber/tap 1070.

Figure 9:
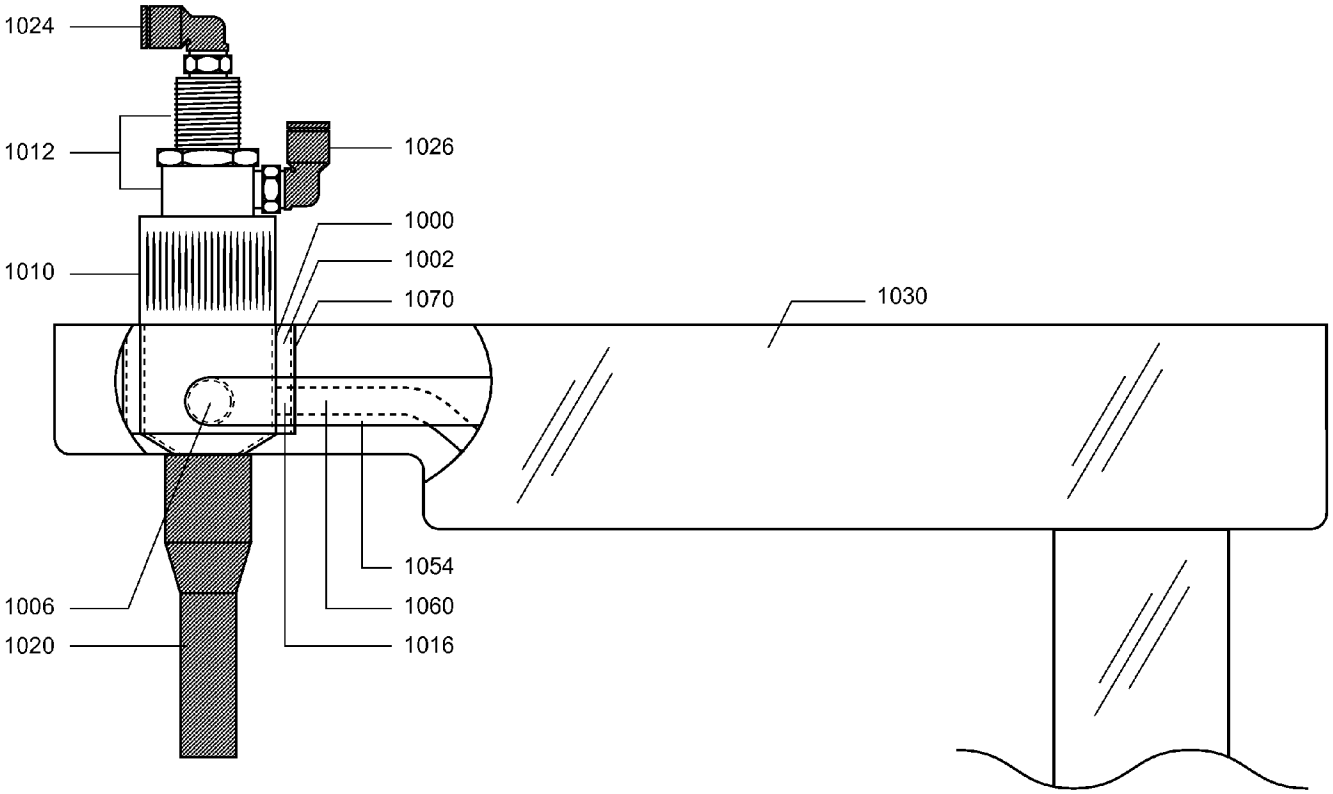
FIG. 9 is a partial side view with a sectional cutaway, showing the beverage control tap, the coolant chamber, and related structures.
Figure 11:
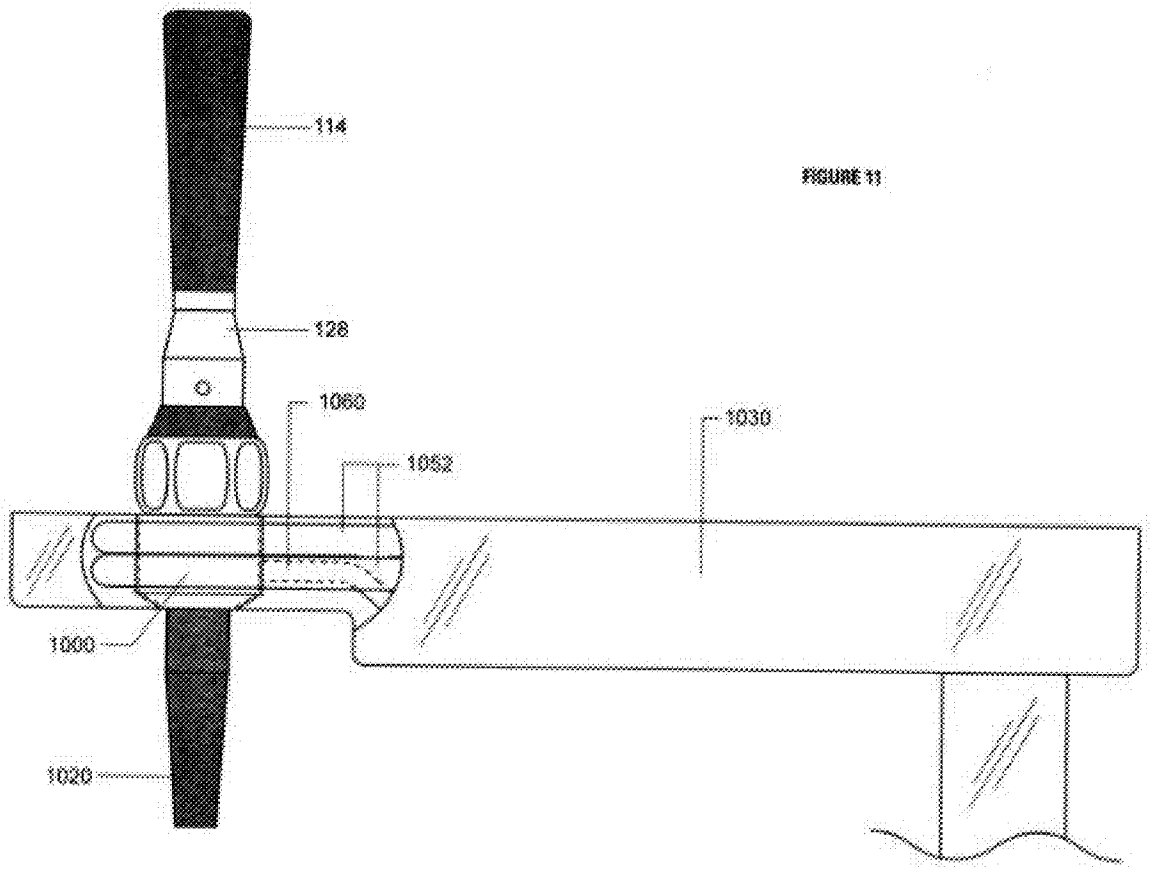
FIG. 11 is a partial side view with a sectional cutaway, showing the traditional manual tap and related structures within the present invention's earliest embodiments.

FIG. 9 is a partial side view with a sectional cutaway of the cold block, showing the beverage control tap, the coolant chamber, and related structures, while FIG. 11 is a partial side view with a sectional cold block cutaway, showing the traditional manual tap and related structures within the present invention. Arrangements are similar in both embodiments of the invention shown here. For the control portion & chambered tap, tap body 1000 is situated inside of coolant chamber 1002, itself within cold block 1030. Coolant chamber outlet 1006 and tap beverage inlet 1016 may be seen in transparency, while the various details of the solenoid are as previously described. Lower coolant channel 1054 and beverage feed line 1060 may also be seen providing coolant and beverage (respectively) to the chambered tap 1070. Obviously, the manual tap is similar but lacks the various solenoid aspects.

One important difference between these two embodiments is that the chamber (which may be present in either type) is used in one case and not in the other. In embodiments in which the chamber is used, the coolant surrounding the tap body provides a faster and more direct heat exchange. However, the embodiments with no chamber may be simpler to manufacture. Both embodiments are preferred at this time, although the chambered embodiment may well turn out to be "more preferred" in the light of experience.

The cold block shape need not be a simple prism, it can be any advantageous shape.

Figures 10A, 10B, 10C:
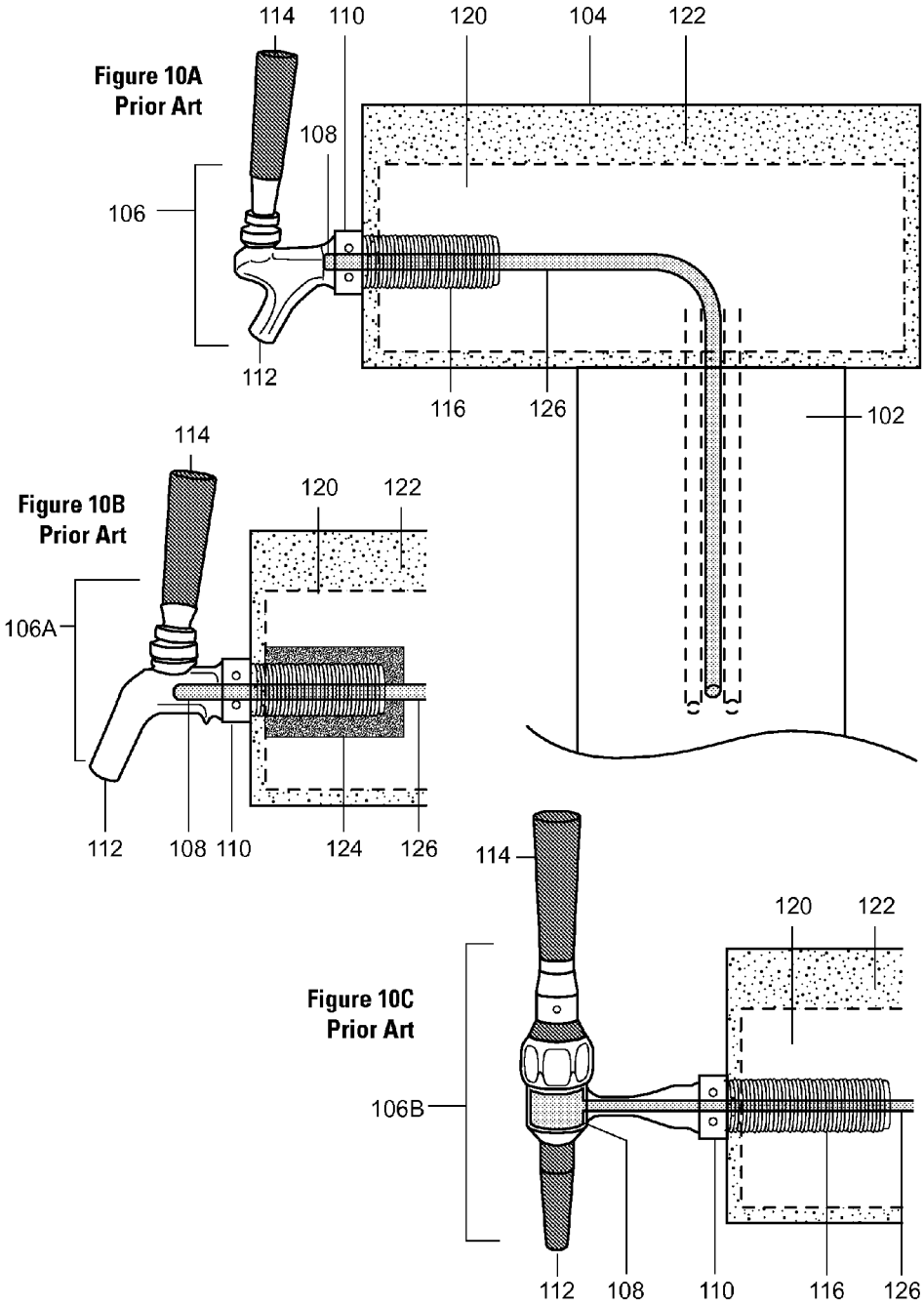
Figure 10A Prior Art
Figure 10B Prior Art
Figure 10C Prior Art
FIGS. 10A, 10B, 10C are views showing various prior art patents, most particularly, showing how various devices (such as the Perlick device and the devices of the prior art inventors referenced previously) do not in fact maintain cool beverage temperatures all the way to the final dispensing.

FIGS. 10A, 10B, 10C are views showing various prior art patents, most particularly, showing how various devices (such as the Perlick device and the devices of the prior art inventors referenced previously) do not in fact maintain cool beverage temperatures all the way to the final dispensing.

In typical scenarios for PRIOR ART, Tower 102 has external to Tower top 104 a tap. This tap may be one of various types. Depicted herein are three types: General tap 106, Perlick Sanitary Tap 106A, and Stout Tap 106B. These are taken from PRIOR ART referenced previously in the "Background" of this disclosure and discussed there in detail.

Significantly, Valve Point of Dispense 108 and the following Tap Orifice (outlet) 112 are well outside of Cold Block 120. Cold Block Insulating Foam 122 is used for further cooling, but of course does not compensate for the unhygienic fact that there is always some small amount of beverage outside of the cold block, warming and growing pathogens, because these designs do NOT embed the tap truly within the cold block. What is actually embedded is a shank assembly or Embedded Shank Socket (optional) 124 and most but not all of the length of the Beverage Cooling Channel 126.

The disclosure is provided to allow practice of the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

What is claimed is:

1. A beverage dispensing device comprising:

a cold block having a body made of a heat conducting material;

at least one tap, its beverage/valve portions embedded within a coolant chamber embedded within the cold block;

at least one beverage channel passing through the cold block to the at least one tap;

at least one coolant channel passing through the cold block to the coolant chamber, the coolant channel terminating at a coolant chamber inlet, the coolant chamber having an interior, the coolant chamber interior being larger than the coolant channel.

2. The beverage dispensing device of claim 1, wherein the at least one beverage channel and the coolant channel are serpentine within the cold block.

3. The beverage dispensing device of claim 1, further comprising:

a beverage tower, the cold block disposed within the beverage tower.

4. The beverage dispensing device of claim 1, further comprising:

a second tap, its beverage/valve portions embedded within the cold block;

a second beverage channel passing through the cold block to the second tap;

the at least one coolant channel passing through the cold block to the second tap and passing about the second tap within the cold block.

5. The beverage dispensing device of claim 4, further comprising:

a glycol return allowing glycol in the cold block coolant channel to re-circulate to a glycol cooling and re-circulation unit.

6. The beverage dispensing device of claim 5, further comprising:

first and second beverage supplies.

7. The beverage dispensing device of claim 6, further comprising:

first and second beverage supplies, wherein the first and second beverage supplies further comprise containers having therein one member selected from the group consisting of:

milk, non-dairy products, carbonated and non-carbonated beer, other alcoholic beverages, syrups, water, coffee and tea, fruit juice and combinations thereof.

8. The beverage dispensing device of claim 6, wherein the first and second beverage supplies further comprise containers having therein one member selected from the group consisting of: milk, non-dairy products, carbonated and non-carbonated beer, other alcoholic beverages, syrups, water, coffee and tea, fruit juice and combinations thereof.

9. A beverage dispensing device comprising:

a cold block having a body made of a heat conducting material;

at least one solenoid, the solenoid being at least partially embedded within the cold block;

at least one tap having a tap valve having a portion for containing beverage, the tap valve and its beverage containing portions embedded within a coolant chamber embedded within the cold block, the tap being mechanically engaged to the solenoid whereby the solenoid controls the operation of the tap, the portion of the solenoid mechanically engaged to the tap valve being embedded within the cold block;

at least one beverage channel passing through the cold block to the at least one tap valve beverage containing portions; and at least one coolant channel passing through the cold block to the coolant chamber, the coolant channel terminating at a coolant chamber inlet, the coolant chamber having an interior, the coolant chamber interior being larger than the coolant channel.

10. The beverage dispensing device of claim 9, wherein the at least one beverage channel and the coolant channel are serpentine within the cold block.

11. The beverage dispensing device of claim 10, further comprising:

a beverage tower, the cold block disposed within the beverage tower, a second tap, its beverage/valve portions embedded within the cold block;

a second beverage channel passing through the cold block to the second tap;

the at least one coolant channel passing through the cold block to the second tap and passing about the second tap within the cold block.

12. The beverage dispensing device of claim 11, further comprising:

a glycol return allowing glycol in the cold block coolant channel to re-circulate to a glycol cooling and re-circulation unit.

13. A beverage dispensing device comprising:

a cold block having a body made of a heat conducting material;

at least one tap, its beverage/valve portions embedded within a coolant chamber, the coolant chamber in turn embedded within the cold block;

at least one beverage channel passing through the cold block to the at least one tap;

at least one coolant channel passing through the cold block to the coolant chamber, the coolant channel terminating at a coolant chamber inlet, the coolant chamber having an interior, the coolant chamber interior being larger than the coolant channel.

14. The beverage dispensing device of claim 13, further comprising:

at least one solenoid, the solenoid being at least partially embedded within the coolant chamber;

the tap having a tap valve, the tap valve being mechanically engaged to the solenoid whereby the solenoid controls the operation of the tap, the portion of the solenoid mechanically engaged to the tap valve being embedded within the coolant chamber.

15. The beverage dispensing device of claim 13, wherein the at least one beverage channel and the coolant channel are serpentine within the cold block.

16. The beverage dispensing device of claim 13, further comprising:

a beverage tower, the cold block disposed within the beverage tower, a second tap, its beverage/valve portions embedded within a second coolant chamber also in turn embedded within the cold block;

a second beverage channel passing through the cold block to the second tap;

the at least one coolant channel passing through the cold block to the second coolant chamber.

17. The beverage dispensing device of claim 16, further comprising:

a glycol return allowing glycol in the cold block coolant channel to re-circulate to a glycol cooling and re-circulation unit.

18. The beverage dispensing device of claim 17, further comprising:

first and second beverage supplies, wherein the first and second beverage supplies further comprise containers having therein one member selected from the group consisting of:

milk, non-dairy products, carbonated and non-carbonated beer, other alcoholic beverages, syrups, water, coffee and tea, fruit juice and combinations thereof.

* * * * *